US011245214B2

(12) United States Patent
Hong et al.

(10) Patent No.: US 11,245,214 B2
(45) Date of Patent: Feb. 8, 2022

(54) CONNECTOR, METHOD FOR MANUFACTURING CONNECTOR AND SIGNAL PIN ASSEMBLY

(71) Applicant: Delta Electronics, Inc., Taoyuan (CN)

(72) Inventors: Shouyu Hong, Taoyuan (CN); Qingdong Chen, Taoyuan (CN); Ganyu Zhou, Taoyuan (CN); Pengkai Ji, Taoyuan (CN); Yiqing Ye, Taoyuan (CN); Zhenqing Zhao, Taoyuan (CN)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 16/934,076

(22) Filed: Jul. 21, 2020

(65) Prior Publication Data

US 2020/0350721 A1 Nov. 5, 2020

Related U.S. Application Data

(62) Division of application No. 16/234,861, filed on Dec. 28, 2018, now Pat. No. 10,784,612.

(30) Foreign Application Priority Data

Mar. 7, 2018 (CN) ..... 201810188412.0

(51) Int. Cl.
*H01R 13/22* (2006.01)
*H01R 12/71* (2011.01)
(Continued)

(52) U.S. Cl.
CPC ..... *H01R 13/22* (2013.01); *H01R 12/712* (2013.01); *H01R 13/405* (2013.01); *H01R 43/16* (2013.01)

(58) Field of Classification Search
CPC .... H01R 13/22; H01R 12/712; H01R 13/405; H01R 43/16
(Continued)

(56) References Cited

U.S. PATENT DOCUMENTS 3,998,513 A * 12/1976 Kobayashi ..... H01R 12/714 439/91
4,201,435 A * 5/1980 Nakamura ..... H01R 12/714 428/364
(Continued)

FOREIGN PATENT DOCUMENTS

CN 102064158 A 5/2011
CN 103779343 A 5/2014
(Continued)

OTHER PUBLICATIONS

The IN1OA issued Oct. 14, 2020 by the IN Office.
(Continued)

*Primary Examiner* — Peter G Leigh
(74) *Attorney, Agent, or Firm* — Qinghong Xu

(57) ABSTRACT

The present disclosure provides a connector which is a combination of at least one power pin, one plastic member, and one signal pin, wherein the power pin includes a columnar metal block, each plastic member is connected to the columnar metal block at side surface, each signal pin is attached to a side surface of the plastic member, and extends to two bottom surfaces of the plastic member to form contact surfaces with predetermined areas on the two bottom surfaces; wherein, the contact surface on first bottom surface of the plastic member is flush with first bottom surface of the metal block, and the contact surface on second bottom surface of the plastic member is flush with second bottom surface of the metal block.

6 Claims, 50 Drawing Sheets

(51) Int. Cl.
*H01R 43/16* (2006.01)
*H01R 13/405* (2006.01)

(58) Field of Classification Search
USPC ..... 439/733.1
See application file for complete search history.

(56) References Cited

U.S. PATENT DOCUMENTS 5,107,586 A * 4/1992 Eichelberger ..... H01L 23/32 216/20
5,515,604 A * 5/1996 Horine ..... H01R 12/52 29/830
6,581,276 B2 * 6/2003 Chung ..... H01Q 1/36 257/E25.013
7,405,363 B2 * 7/2008 Inoue ..... H05K 1/117 174/255
7,717,744 B2 5/2010 Ma
2003/0123818 A1 7/2003 Watanabe et al.
2017/0162980 A1 * 6/2017 Szeto ..... H01R 35/04
2018/0124922 A1 * 5/2018 Ji ..... H01L 21/565

FOREIGN PATENT DOCUMENTS

CN 205452592 U 8/2016
CN 106571354 A 4/2017
CN 106816424 A 6/2017
CN 106941219 * 7/2017 ..... H01R 13/62
CN 106941219 A 7/2017
CN 107046366 A 8/2017
JP 2013229276 A 11/2013

OTHER PUBLICATIONS

The CN1OA issued Jul. 1, 2020 by the CNIPA.
The 1st Office Action dated Nov. 2, 2021 for CN patent application No. 2020113555437.

* cited by examiner

CONNECTOR, METHOD FOR MANUFACTURING CONNECTOR AND SIGNAL PIN ASSEMBLY

CROSS REFERENCE

This application is a divisional application of U.S. application Ser. No. 16/234,861, which claims priority to Chinese Patent Application No. 201810188412.0, filed on Mar. 7, 2018, the entire contents thereof are incorporated herein by reference.

TECHNICAL FIELD

The present disclosure relates to the field of power supply technology, and more particularly, to a connector, a method for manufacturing a connector, and a signal pin assembly.

BACKGROUND

In recent years, with the development of technologies such as data center and artificial intelligence, large data processors have been developed rapidly. There are some familiar processors in the current market, such as Central Processing Unit (CPU), Graphics Processing Unit (GPU), Field-Programmable Gate Array (FPGA), and Application Specific Integrated Circuit (ASIC), and the like. For these processors, the required power can reach to several hundred watts. In order to meet the power requirement of the processors, low voltage and large current is becoming a trend, which will result in a lager power market value.

Since the power supply transfers power to a processor port through a pin structure, the volume of the power pin can bring a great influence on the power supply efficiency. Meanwhile, the communication between the terminal load and the power supply becomes more and more complicated, and the number of required signal pins is gradually increasing. However, a signal terminal of the power module is usually similar in structure to a power terminal; but actually, the electrical connection requirement of the signal terminal is lower than the power terminal, if using a similar size with power pin, it will waste more module space, which induces a lower power intensity.

Therefore, it is necessary to study a connector, a method for manufacturing a connector, and a signal pin assembly, which can improve the combination form of a signal pin and a power pin, and improve the space utilization, thereby improving the power supply efficiency.

It should be noted that the information disclosed in the above background section is only for enhancement of understanding the background of the present disclosure and therefore can include other information that does not form the prior art that is already known to those of ordinary skills in the art.

SUMMARY

According to an aspect of the present disclosure, there is provided a connector, including:

at least one power pin, including a preformed metal block, the metal block including a plurality of side surfaces in a first direction and a first bottom surface and a second bottom surface in a second direction perpendicular to the first direction:

at least one plastic member, each plastic member being connected to at least one side surface of the metal block in the first direction, and each plastic member including a first bottom surface and a second bottom surface in the second direction; and at least one signal pin, each signal pin being attached to at least one of the plastic members in the first direction, extending to the first bottom surface and the second bottom surface of each plastic member, and respectively forming a contact surface with a predetermined area on the first bottom surface and the second bottom surface;

wherein, the first bottom surface of each metal block is flush with each contact surface formed by each signal pin on the first bottom surface of each plastic member in the second direction, and the second bottom surface of each metal block is flush with each contact surface formed by each signal pin on the second bottom surface of each plastic member in the second direction.

According to another aspect of the present disclosure, there is provided a signal pin assembly, including:

a plastic member, including a plurality of side surfaces in a first direction, and a first bottom surface and a second bottom surface in a second direction perpendicular to the first direction; and at least one signal pin, each signal pin being attached to the at least one plastic member in the first direction and extending to the first bottom surface and the second bottom surface of each plastic member, and respectively forming a contact surface with a predetermined area on the first bottom surface and the second bottom surface.

According to yet another aspect of the present disclosure, there is provided a manufacturing method of a connector, including:

providing at least one preformed metal block, each metal block including a plurality of side surfaces in a first direction and a first bottom surface and a second bottom surface in a second direction perpendicular to the first direction:

forming at least one plastic member, wherein each plastic member is connected to at least one side surface of the metal block in the first direction, and each plastic member includes a first bottom surface and a second bottom surface in the second direction; and forming at least one signal pin, wherein each signal pin is attached to at least one of the plastic members in the first direction and extends to the first bottom surface and the second bottom surface of the plastic member, and respectively forms a contact surface with a predetermined area on the first bottom surface and the second bottom surface of the plastic member;

wherein, the first bottom surface of each metal block is flush with each contact surface formed by each signal pin on the first bottom surface of each plastic member in the second direction, and the second bottom surface of each metal block is flush with each contact surface formed by each signal pin on the second bottom surface of each plastic member in the second direction.

It should be understood that the foregoing general description and the following detailed description are exemplary and explanatory only, and cannot limit the present disclosure.

BRIEF DESCRIPTION OF THE DRAWINGS

The accompanying drawings herein are incorporated in and constitute a part of this description, illustrate the embodiments in conformity with the invention, and serve to explain the principles of the invention together with the description. Obviously, the drawings in the following description merely relate to some embodiments of the invention, and based on these drawings, those of ordinary skills in the art may obtain other drawings without going through any creative effort.

DETAILED DESCRIPTION

Figure 1:
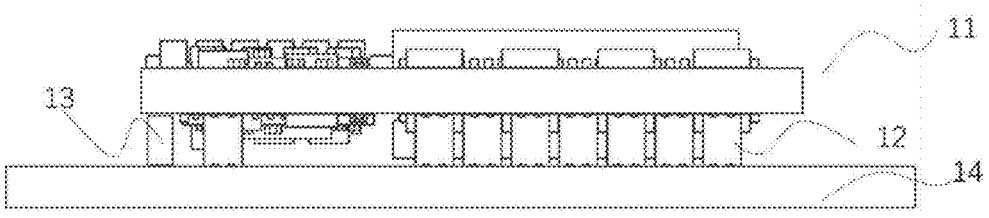
Fig.1(Prior Art)
FIG. 1 schematically illustrates a side view of applying a power module to a system substrate in the related art.

The example embodiments will be now described more comprehensively with reference to the drawings. However, the example embodiments can be embodied in many forms and should not be construed as being limited to the embodiments set forth herein; on the contrary, these embodiments are provided so that the invention will be more comprehensive and complete, and the concept of the example embodiments will be comprehensively conveyed to those skilled in the art. Furthermore, the described features, structures, or characteristics may be combined in any suitable manner in one or more embodiments. In the following description, numerous specific details are set forth, so as to give sufficient understanding on the embodiments of the invention. However, those skilled in the art will appreciate that the technical solution of the invention may be practiced while omitting one or more of the specific details, or other methods, constituent elements, materials, devices, steps, etc. In other instances, various aspects of the present disclosure are not obscured by the detailed illustration or description of the known technical solutions to avoid distracting.

In addition, the drawings are merely schematic representations of the invention and are not necessarily to scale. The same reference numerals in the drawings denote the same or similar parts; therefore, the repeated description thereof will be omitted. Some block diagrams shown in the drawings are merely functional entities and do not necessarily have to correspond to physically or logically separate entities. These functional entities may be implemented in software, or these functional entities are implemented in one or more hardware modules or integrated circuits, or these functional entities are implemented in different network and/or processor apparatuses and/or microcontroller apparatuses.

Figure 2A:
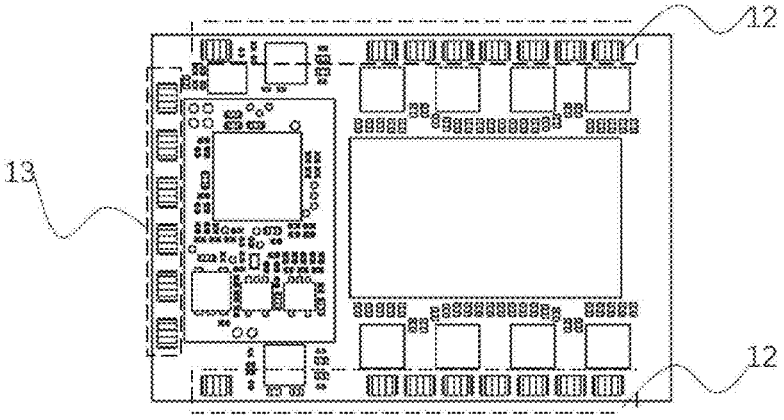
Fig.2a(Prior Art)
FIG. 2*a* schematically illustrates a bottom view of the power module in FIG. 1.
Figure 2B:
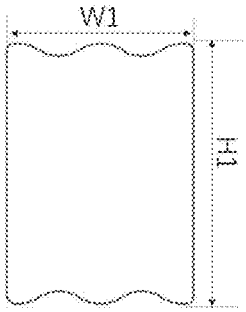
Fig.2b(Prior Art)
FIG. 2*b* schematically illustrates a front view of a pin structure of the power module in FIG. 1.
Figure 2C:
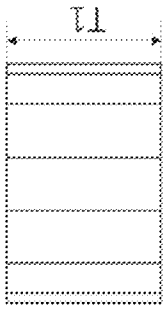
Fig.2c(Prior Art )
FIG. 2*c* schematically illustrates a top view of the pin structure of the power module in FIG. 1.

FIG. 1 schematically illustrates a side view of applying a power module to a system substrate in the related art; FIG. 2*a* schematically illustrates a bottom view of the power module in FIG. 1; and FIG. 2*b* and FIG. 2*c* schematically illustrate a front view and a top view of a pin structure of the power module in FIG. 1, respectively.

The power module 11 is connected to the system substrate 14 through a power pin 12 and a signal pin 13 to realize perpendicular connection of power and signals between the power module 11 and the system substrate 14. The power pin 12 adopts a preformed metal block structure. Using the metal block for power extraction has the advantages of small impedance, strong through-current capacity, and good heat dissipation, which has certain advantages for improving the efficiency and heat dissipation performance of the power module. In practical applications, due to the influence of the process, it is generally required that a height H1 of the pin is smaller than a certain magnification (for example, twice) of its thickness T1, otherwise, the metal block may be unstable during reflow process. This limitation may affect the application of the technology in some specific occasions. For example, for some power modules that require high efficiency and power density, a relatively low operating frequency is usually used to reduce the switching loss of a switching device. And then a height of a required magnetic component will be increased, so that the distance between the module substrate 11 and the system board 14 is increased, and a width of the power pin 12 should be increased in order to reduce the risk of the reflow process, which in turn causes a decrease in the power density. Therefore, it is difficult for the solution to simultaneously meet the requirements of high efficiency and high power density. Furthermore, for the signal pin 13, since a current through signal pin is very small, there only need tens of micrometers width or thickness for the signal pin, but using the metal block with a limited aspect ratio for signal transmission will cause serious space waste. Moreover, when using a plurality of independent signal terminals, due to the effect of assembly tolerances, there is also a certain requirement on the distance between the terminals, which further reduces the configuration density of the signal terminals.

In practical applications, the signals of the power module mainly includes communication signals (such as clock signals, data signals, alarm signals, etc.), on-off signals, current detection signals, temperature detection signals, control driving signals, fault reporting signals, etc. With the continuously increasing requirements on the intelligent module, the number of required signal terminals is also increasing. If adopting the independent pin structure, it will make the power module footprint larger and larger, which will have a significant adverse effect on the power density of the module.

FIGS. 3*a* to 12*d* illustrate related schematic diagrams of a connector, a method for manufacturing a connector, and a signal pin assembly provided by the present disclosure.

A connector provided by the present disclosure may include at least one power pin, at least one plastic component, and at least one signal pin, wherein the power pin may include a preformed metal block including a plurality of side surfaces in a first direction, and a first bottom surface and a second bottom surface in a second direction perpendicular to the first direction; each plastic member is connected to at least one side surface of the metal block in the first direction, and each plastic member similarly includes a first bottom surface and a second bottom surface in the second direction; each signal pin is attached to at least one plastic member in the first direction, extends to the first bottom surface and the second bottom surface of the plastic member, and respectively forms contact surfaces with a predetermined area on the first bottom surface and the second bottom surface of the plastic member; in addition, lengths of each metal block, each plastic member and each signal pin in the first direction are matched, such that the first bottom surface of each metal block is in flush with each contact surface formed by each signal pin on the first bottom surface of each plastic member in the second direction, and the second bottom surface of each metal block is in flush with each contact surface formed by each signal pin on the second bottom surface of each plastic member in the second direction.

The connector according to the present exemplary embodiment has the advantages and positive effects as follows:

the connector provided by the present disclosure is a combination of power pin, plastic member and signal pin, wherein the power pin includes a columnar metal block, and the power pin, the plastic member and the signal pin are connected at the side surfaces to enable the connector to be formed with a stable columnar structure. In the connector provided by the present disclosure, both the power pin and the signal pin form contact surfaces on the two bottom surfaces of the columnar structure, so that the connector can simultaneously realize the electrical connection functions of the signal pin and the power pin. The connector provided by the present disclosure is convenient to reflow process, and has a high stability and a high flatness on one hand; on the other hand, the connector avoids the space waste caused by the traditional power or signal pin, which need to ensure the reflow stability with the limitation of a height to width aspect ratio, and improves the space utilization; moreover, the size required for the electrical connection of the signal pin is very small, and a plurality of signal pins can be simultaneously disposed on the plastic member depending on the stability of the connector without extra space, thereby increasing the arrangement density of the signal terminals, thus improving the power density and further improving the power supply efficiency.

Embodiment 1

Figure 3A:
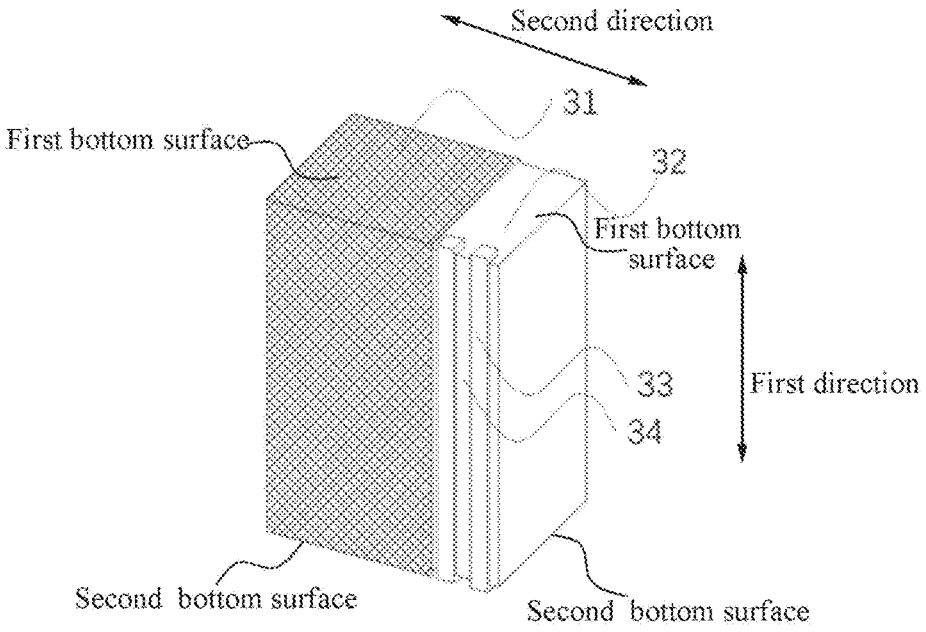
FIG. 3*a* schematically illustrates a structural diagram of a connector according to an exemplary embodiment of the present disclosure.
Figure 3B:
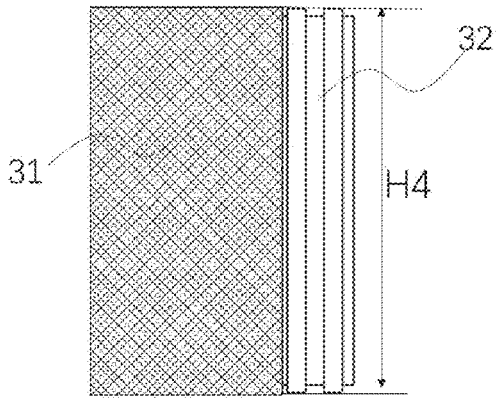
FIG. 3*b* schematically illustrates a front view of the connector according to an exemplary embodiment of the present disclosure.
Figure 3C:
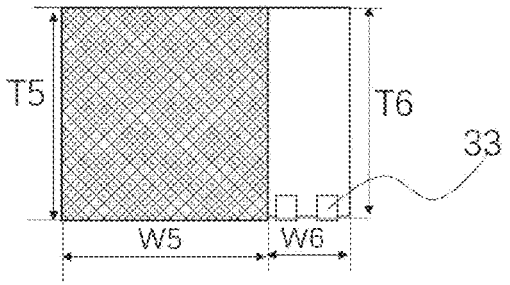
FIG. 3*c* schematically illustrates a top view of the connector according to an exemplary embodiment of the present disclosure.
Figure 3D:
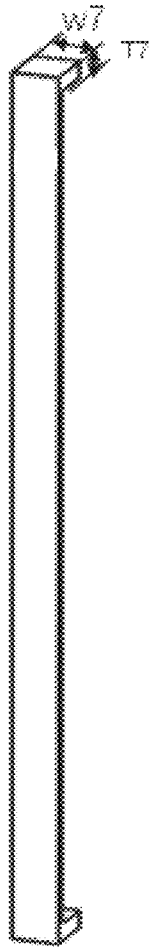
FIG. 3*d* schematically illustrate a structural diagram of a signal pin in the connector according to an exemplary embodiment of the present disclosure.

FIG. 3*a* and FIG. 3*b* schematically illustrate a structural view and a front view of a connector according to an exemplary embodiment of the present disclosure, respectively; FIG. 3*c* schematically illustrates a top view of a connector according to an exemplary embodiment of the present disclosure; and FIG. 3*d* schematically illustrate a structural view of a signal pin in the connector according to an exemplary embodiment of the present disclosure.

As shown in FIG. 3*a* and FIG. 3*b*, the connector may include a preformed metal block 31 and a plastic member 32. The metal block 31 includes four side surfaces in a vertical direction and two bottom surfaces in a horizontal direction, i.e., a first bottom surface and a second bottom surface. The plastic member 32 is connected to a vertical side surface of the metal block 31. On the surface 34 of the plastic member 32, two signal pins 33 are disposed, and the signal pins 33 are attached to an outer sidewall of the plastic member 32 in the vertical direction, and extend to two bottom surfaces of the plastic member 32, i.e., the first bottom surface and the second bottom surface, and bend at junctions between the outer sidewall of the plastic member 32 and the two bottom surfaces to form contact surfaces with a predetermined area on the two bottom surfaces of the plastic member 32. A height of the connector is the same as the heights of the metal block 31 and the signal pin 33, all of which is H4. Moreover, to keep the stability of the connector during reflow process, a half of a length of the connector in the vertical direction may be less than a length of the connector in the horizontal direction, i.e., a half of the length (i.e., the height H4) of the connector in the vertical direction is less than the length (i.e., W5+W6) in the horizontal direction in the embodiment.

As shown in FIG. 3*c*, a width W5 of the metal block 31 may be greater than or equal to 0.5 mm, and a thickness T5 may be greater than or equal to 0.5 mm. The material of the metal block 31 is a conductive material such as copper, copper clad aluminum or the like. The metal block may be formed by a stamping process, and an anti-oxidation film such as Ni (nickel), Au (gold) or the like may be coated on the surface. The metal block 31 has a columnar shape, and a cross section thereof may be a trilateral shape, a quadrangle shape, or a circular shape. In addition, in some example embodiments, the first surface and/or the second surface of the metal block may be a flat surface at a certain horizontal height, or may be an uneven surface at a certain horizontal height, for example, a wave-shaped surface, a square wave pulse type surface, a bell-shaped wave surface, etc., all of which can realize a structure in which the metal block can be combined with the plastic member and the signal pin to form a stable connector are within the protection scope of the present disclosure, and no special restrictions are made here in the present disclosure.

The plastic member 32 has a width W6 greater than 0.5 mm and a thickness T6 greater than 0.5 mm. The plastic member 32 is made of an insulating material, for instance, a thermosetting material such as an epoxy resin or a silicone resin, or a thermoplastic material like one or more of Polyphenylene Sulfide (PPS), polyamide, Polycarbonate (PC), and Polybutylene Terephthalate (PBT).

As shown in FIG. 3*d*, a cross section of the signal pin 33 may be a trilateral shape, a quadrangle shape, or a circular shape. The material of the signal pin 33 is metallic copper. Taking the rectangular cross section of the signal pin 33 as an example, a width W7 of the signal pin 33 may be greater than or equal to 50 micrometers, and a thickness T7 may be greater than or equal to 10 micrometers. The connector integrates the power pin and the signal pin to improve the stability during reflow and the flatness of the module after reflow.

A manufacturing process of the connector in the exemplary embodiment may be as follows: firstly, the metal block 31 and the plastic member 32 are combined together through a molding process, and then a signal pin 33 is formed on the surface of the plastic member 32 through a metallization process. Since the signal pin 33 has a specific pattern requirement, the metallization process typically requires to have a selectivity. i.e., a metallization layer is formed only on a location where it is needed, and will not be formed at the remaining locations. At this moment, the requirement may be achieved by a laser activation process in combination with electroless plating process. The purpose of the laser activation is to make the surface of the plastic member have selectivity to the electroless plating. There are usually two methods: one method is that the selected plastic member internally contains an activation element required for the electroless plating, such as palladium, etc., and the activation element is exposed to the surface by laser ablation, and then by electroless plating process, metal copper will be deposited on the exposed surface, which have the activated element, thereby achieving selective electroless plating; and another method is to change the roughness of the surface of the plastic member by laser ablation, and then choose an active agent, which have selectivity to the roughness thereof, finally achieving selectivity electroless plating. Due to the low efficiency of the electroless plating process, it is also possible to thicken the metallization layer by electroplating (such as barrel plating, etc.) on a thin metal layer produced by electroless plating.

Embodiment 2

FIG. 4*a* to FIG. 4*f* schematically illustrate top views of a preformed metal block and a plastic member forming connecting bodies in different shapes according to some exemplary embodiments of the present disclosure.

Figure 4A:
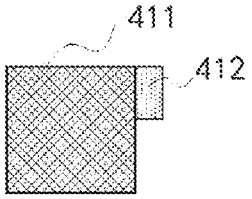
FIG. 4*a* to FIG. 4*f* schematically illustrate top views in which a preformed metal block and a plastic member form connecting bodies with different shapes according to some exemplary embodiments of the present disclosure.
Figure 4B:
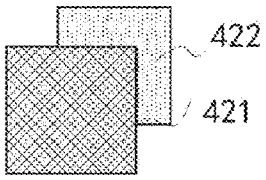
Figure 4C:
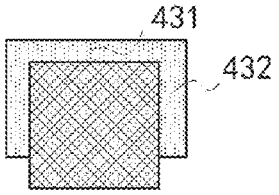
Figure 4D:
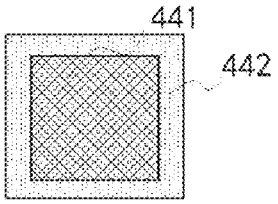
Figure 4E:
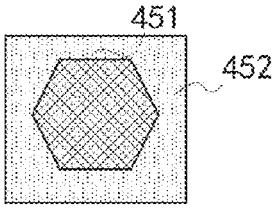
Figure 4F:
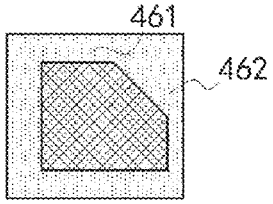

The second embodiment is consistent with the basic features of the first embodiment. As can be seen from FIG. 4*a* to FIG. 4*d*, the metal block may have a surface connected to the plastic member, such as a metal block 411 and a plastic member 412, or the metal block may have a plurality of surfaces connected to the same plastic member, such as a metal block 421 and a plastic member 422, a metal block 431 and a plastic member 432, and a metal block 441 and a plastic member 442. FIG. 4*e* illustrates a metal block 451 and a plastic member 452. FIG. 4*f* illustrates a metal block 461 and a plastic member 462. As can be seen from FIG. 4*e* and FIG. 4*f*, cross sections of the metal blocks and the plastic members may be any polygonal shape, or irregular shapes or the like, and a shape of a connecting body obtained by the combination of the metal block and the plastic member also exhibits diversity. The shape of the connecting body of this embodiment is not limited to those listed in FIGS. 4*a* to 4*f*. The advantage of this embodiment is that the design of the connecting body is flexible and can fully satisfy the stability requirement of the metal block.

Embodiment 3

FIG. 5*a* to FIG. 5*f* schematically illustrate top views of a plastic member and a plurality of preformed metal blocks forming connecting bodies in different shapes according to an exemplary embodiment of the present disclosure.

Figure 5A:
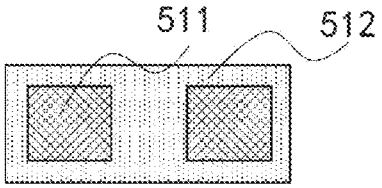
FIG. 5*a* to FIG. 5*f* schematically illustrate top views in which a plastic member and a plurality of preformed metal blocks form connecting bodies with different shapes according to some exemplary embodiments of the present disclosure.
Figure 5B:
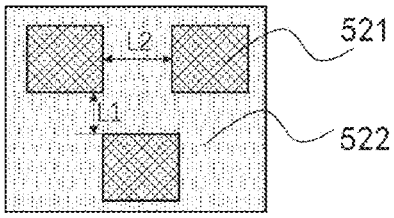
Figure 5C:
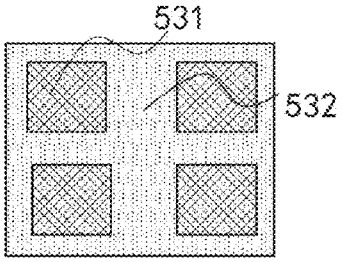
Figure 5D:
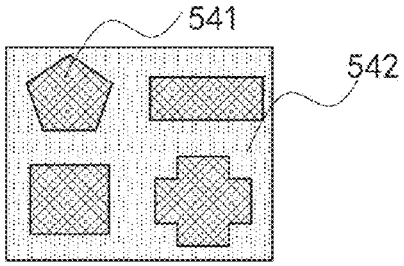
Figure 5E:
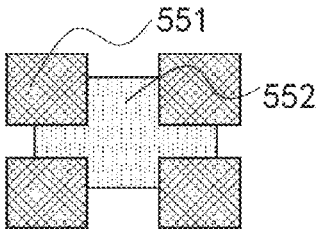
Figure 5F:
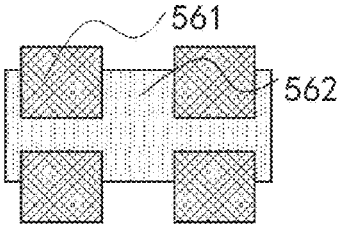
Figure 6A:
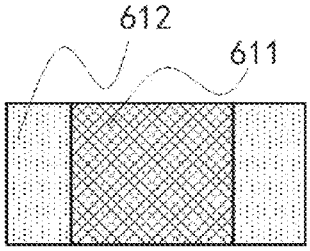
FIG. 6*a* to FIG. 6*f* schematically illustrate top views in which a preformed metal block and a plurality of plastic members form connecting bodies with different shapes according to some exemplary embodiments of the present disclosure.
Figure 6B:
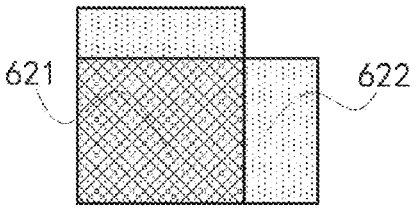
Figure 6C:
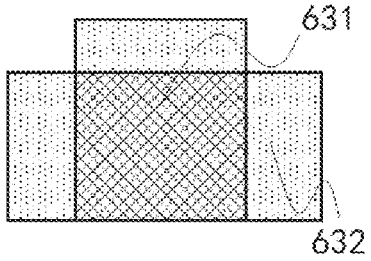
Figure 6D:
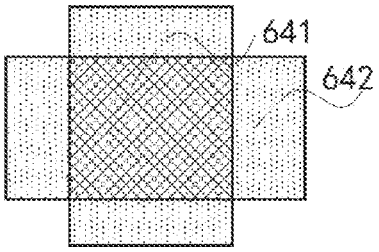
Figure 6E:
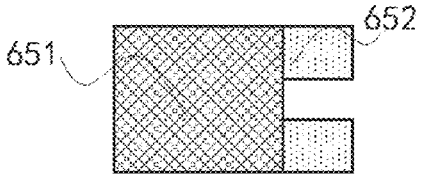
Figure 6F:
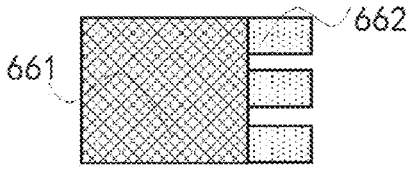
Figure 7A:
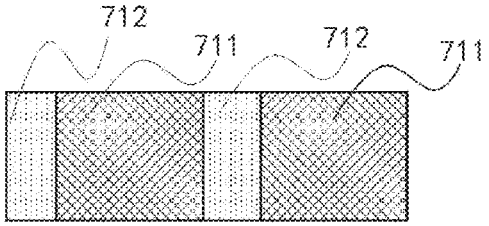
FIG. 7*a* to FIG. 7*d* schematically illustrate top views in which a plurality of preformed metal blocks and a plurality of plastic members form connecting bodies with different shapes according to some exemplary embodiments of the present disclosure.
Figure 7B:
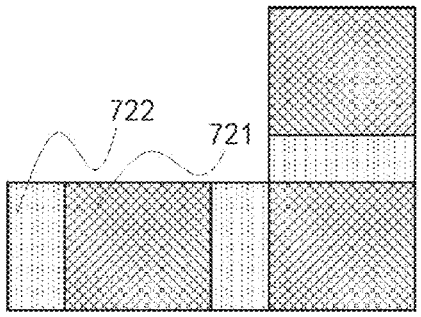
Figure 7C:
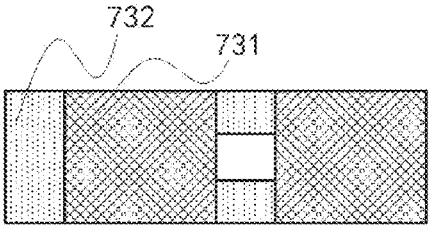
Figure 7D:
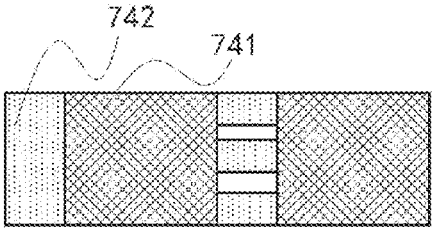
Figure 8A:
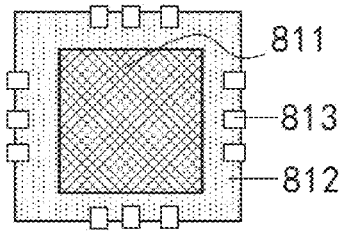
FIG. 8*a* to FIG. 8*d* schematically illustrate top views of signal pins formed on outer sidewalls of plastic members of the connecting bodies with different shapes according to some exemplary embodiments of the present disclosure.
Figure 8B:
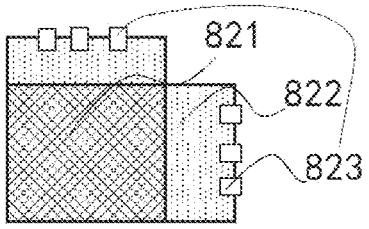
Figure 8C:
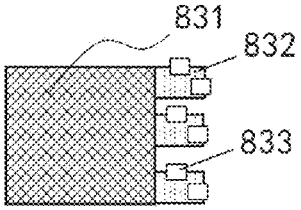
Figure 8D:
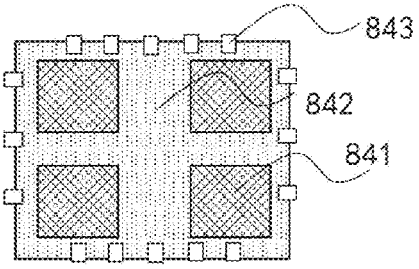
Figure 9A:
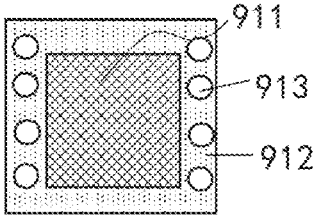
FIG. 9*a* to FIG. 9*d* schematically illustrate top views of signal pins formed on sidewalls of through holes of the connecting bodies with different shapes according to some exemplary embodiments of the present disclosure.
Figure 9B:
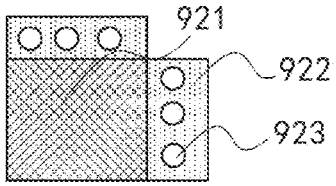
Figure 9C:
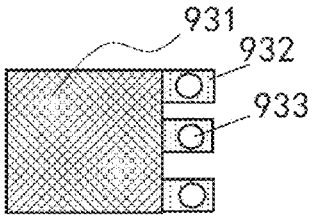
Figure 9D:
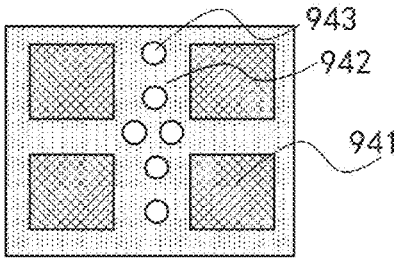
Figure 10A:
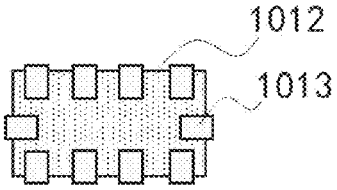
FIG. 10*a* to FIG. 10*d* schematically illustrate top views in which plastic members with different shapes and signal pins form a signal pin assembly structure according to some exemplary embodiments of the present disclosure.
Figure 10B:
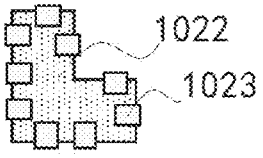
Figure 10C:
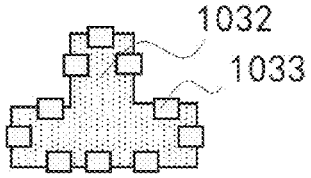
Figure 10D:
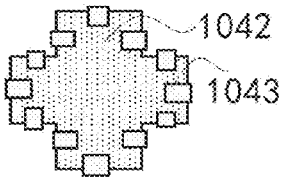

The third embodiment is consistent with the basic features of the first embodiment. As can be seen from FIG. 5*a* to FIG. 5*d*, the plastic member wraps up a plurality of metal blocks to form a connecting body, such as a plastic member 512 and two metal blocks 511 in FIG. 5*a*, and a plastic member 522 and three metal blocks 521 in FIG. 5*b*. FIG. 5*b* illustrates that the distances L1 and L2 between two metal blocks may be the same or different. FIG. 5*d* illustrates that the shapes and sizes of the metal blocks in the same connecting body may be the same or different. It can be seen from FIG. 5*e* to FIG. 5*f* that the plastic member is connected to a plurality of metal blocks, wherein the metal blocks are partially wrapped by the plastic member. The metal blocks shown in FIG. 5*a* to FIG. 5*f* are arranged in a linear array, but the metal blocks of the present disclosure are not limited to this array form. The shape of the connecting body in this embodiment is not limited to those listed in FIGS. 5*a* to 5*f*. The advantage of this embodiment is that a plurality of metal blocks are wrapped by one plastic member, which can comprehensively improve the stability of a plurality of metal blocks during reflow process, and also improves the module flatness.

Embodiment 4

FIG. 6*a* to FIG. 6*f* schematically illustrate top views of a preformed metal block and a plurality of plastic members forming connecting bodies in different shapes according to some exemplary embodiments of the present disclosure.

The fourth embodiment is consistent with the basic features of the first embodiment. As can be seen from FIG. 6*a* to FIG. 6*d*, each side surface of the metal block may be connected to the plastic member. Taking the cross sections of both the metal block and the plastic member as a quadrilateral shape for example, the combination of the metal block and the plastic member may be a long strip type in FIG. 6*a*, an L type in FIG. 6*b*, a T shape in FIG. 6*c*, and a cross type in FIG. 6*d*, etc. In addition, in other embodiments, the shapes of the cross sections of the metal block or the plastic member may be any polygonal shapes, or irregular shapes, and the shape of the connecting body obtained by the combination of the metal block and the plastic member may also be diverse. As can be seen from FIG. 6*e* to FIG. 6*f*, the same side surface of the metal block may be connected to a plurality of plastic members. Moreover, the shapes and sizes of the plastic members in the same connecting body may be the same or different. The shape of the connecting body of the present disclosure is not limited to those listed in FIGS. 6*a* to 6*f*. The advantage of this embodiment is that the design of the assembly is very flexible, and the plastic member may be obtained by a molding process by fully utilizing a gap between the metal block and a device, so as to meet the stability requirements of the combined structure.

Embodiment 5

FIG. 7*a* to FIG. 7*d* schematically illustrate top views of a plurality of preformed metal blocks and a plurality of plastic members forming connecting bodies in different shapes according to some exemplary embodiments of the present disclosure.

The fifth embodiment is consistent with the basic features of the first embodiment. It can be seen from FIG. 7*a* to FIG. 7*b* that the assembly may include a plurality of metal blocks, and the metal blocks are connected by the plastic member.

The shapes and sizes of the metal blocks in the same combined structure may be the same or different. It can be seen from FIG. 7*c* to FIG. 7*d* that a plurality of plastic members may be included between two metal blocks, and the shapes and sizes of the plastic members may be the same or different. The metal blocks shown in FIG. 7*a* to FIG. 7*d* are arranged in a linear array, but the metal blocks of the present disclosure are not limited to this array form. The advantage of this embodiment is that a plurality of metal blocks and a plurality of plastic members are combined into one connecting body, which makes reflow process more convenient, so that the stability of metal block is improved, and the module flatness after reflow process is high.

Embodiment 6

FIG. 8*a* to FIG. 8*d* schematically illustrate top views of signal pins formed on outer sidewalls of plastic members of the connecting bodies in different shapes according to some exemplary embodiments of the present disclosure.

The sixth embodiment is consistent with the basic features of the first embodiment. In the case where the connecting body includes one metal block or a plurality of metal blocks, one plastic member or a plurality of plastic members, the signal pins may be formed by metallization on the outer sidewall of the plastic member. Since a width of the signal pin may be 50 microns, there can be set more signal pins on the plastic member. For example, the connector in FIG. 8*b* includes one metal block 821, two plastic members 822, and a plurality of signal pins 823. The advantage of this embodiment is that depending on the stability of the combined structure, the signal pins can be formed on any sidewall of the plastic member, therefore the signal pin distribution is very flexible. Since the size of the signal pin is very small, the signal pin density is significantly increased in a certain space.

Embodiment 7

FIG. 9*a* to FIG. 9*d* schematically illustrate top views of signal pins formed on sidewalls of through holes of the connecting bodies in different shapes according to some exemplary embodiments of the present disclosure.

The seventh embodiment is consistent with the basic features of the first embodiment. In the case where the connecting body includes one metal block or a plurality of metal blocks, one plastic member or a plurality of plastic members, one or more through holes may be formed in each plastic member firstly, and then the signal pins may be formed in each inner sidewall of the through holes of the plastic member through a metallization process, and each signal pin is extended to the two bottom surfaces of the plastic member to form contact surfaces with a predetermined area on both bottom surfaces of the plastic member, so that both the signal pin and the metal block may form a contact surface at the same side to establish an electrical connection with a substrate. For example, the connector in FIG. 9*d* includes one plastic member 942, four metal blocks 941, and a plurality of signal pins 943. Since a width of the signal pin may be 50 microns, a high density signal pin may be placed in the plastic member. The advantage of this embodiment is that depending on the stability of the combined structure, the signal pin can be formed on any position in the plastic member, so the signal pin distribution is very flexible. Since the size of the signal pin is very small, the signal pin density is significantly increased in a certain space.

Embodiment 8

The present disclosure also provides a signal pin assembly, as shown in FIG. 10*a* to 10*d*, which may include a plastic member and at least one signal pin. The plastic member may include a plurality of side surfaces in a first direction, and a first bottom surface and a second bottom surface in a second direction perpendicular to the first direction. Each signal pin is attached to the plastic member in the first direction and extends to the two bottom surfaces of the plastic member, and forms contact surfaces with a predetermined area on the two bottom surfaces. The advantage of this signal pin assembly is that a high-density signal pin can be formed on the surface depending on the stability of the plastic member, thereby increasing the signal pin density.

FIG. 10*a* to FIG. 10*d* schematically illustrate top views of plastic members in different shapes and signal pins forming a signal pin assembly structure according to some exemplary embodiments of the present disclosure.

This embodiment differs from the top seven embodiments in that the assembly contains only one plastic member and the signal pins formed on the surface of the plastic member, and does not include a metal block. The applicable background of this structure is that the metal block structure is stable, but the signal pin density is very large. The shape of the plastic member may be a long strip type, an L shape, a T shape, a cross type or the like. The signal pin may be formed by a metallization process on any sidewall of the plastic member. In addition, it is also possible to form a through hole by laser drilling inside the plastic member, and then form a signal pin through a metallization process on an inner sidewall of the through hole. Since a width of the signal pin may be 50 microns, a high density signal pin can be placed on the plastic member. The advantage of this embodiment is that depending on the stability of the plastic member, the signal pins can be formed on any position of the outer sidewall or the inside sidewall of the plastic member, therefore the signal pin distribution is very flexible, thus improving the signal pin density.

Embodiment 9

The present disclosure further provides a method for manufacturing a connector, which may include the following steps.

In step I, at least one preformed metal block is provided, each metal block including a plurality of side surfaces in a first direction, and a first bottom surface and a second bottom surface in a second direction perpendicular to the first direction.

In step II, at least one plastic member is formed, such that each plastic member is connected to at least one side surface of the metal block in the first direction, and each plastic member includes a first bottom surface and a second bottom surface in the second direction.

In step III, at least one signal pin is formed, such that each signal pin is attached to at least one of the plastic member in the first direction and extends to the first bottom surface and the second bottom surface of the plastic member, and respectively form contact surfaces with a predetermined area on the two bottom surfaces of the plastic member.

Lengths of each metal block, each plastic member and each signal pin in the first direction are matched, such that the two bottom surfaces of each metal block are in flush with the contact surfaces formed by each signal pin on the two bottom surfaces of each plastic member in the second direction.

In the example embodiment, the at least one signal pin may be formed using one or two of an electroplating process and an electroless plating process. The at least one plastic member may be formed using one or two of a molding process or a PCB process.

FIG. 11*a* to FIG. 11*d* schematically illustrate the processing of the pin assembly structure by a Laser Direct Structuring (LDS) process according to the present disclosure.

Figure 11A:
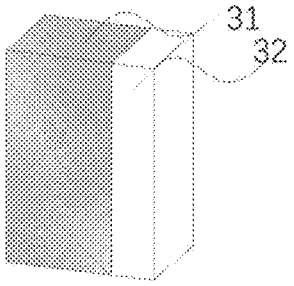
FIG. 11*a* to FIG. 11*d* schematically illustrate the processing of the pin assembly structure by a Laser Direct Structuring (LDS) process according to the present disclosure.
Figure 11B:
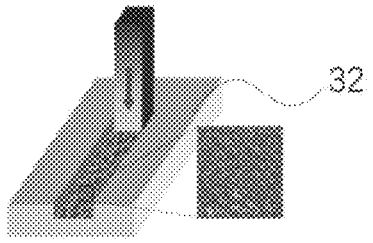
Figure 11C:
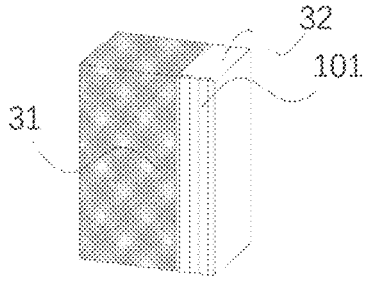
Figure 11D:
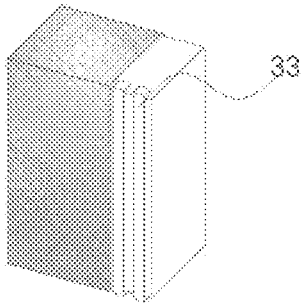

The ninth embodiment is consistent with the basic feature of the first embodiment. FIG. 11*a* to FIG. 11*d* illustrate the processing of the pin assembly structure by Laser Direct Structuring (LDS) process. The implementation process is as follows: FIG. 11*a*, Molding: a thermoplastic material containing a special chemical additive (also called an active agent, or a priming agent) is selected for molding with a preformed metal block 31, so as to obtain a plastic member 32, the thermoplastic material including a crystalline polymer and an amorphous polymer such as Polyamide (PA), Polyphenylene Sulfide (PPS), Polycarbonate (PC), Polybutylene Terephthalate (PBT), etc; FIG. 11*b*, Laser Activation: a physicochemical reaction occurs on a surface of the plastic member by a laser beam; FIG. 11*c*, after the physicochemical reaction, a seed layer 101 is obtained along the laser-swept path, and the seed layer contains an active element required for copper plating; FIG. 11*d*, a certain thickness of copper is grown on the surface of the seed layer by electroless copper plating or electro copper plating, and finally, a layer of anti-oxidation material such as Ni or Au is plated on the surface. The starting point of this embodiment is to explain the implementation engineering of the pin combination structure from the view of process, and the advantage of the process lies in laser direct structuring, convenient and flexible figure definition, and low cost. Since the laser acts only on the additive, the seed layer is in an uneven state, which can improve the surface binding force between the plated layer and the plastic member matrix, so as to induce a high structure reliability.

Embodiment 10

FIG. 12*a* to FIG. 12*d* schematically illustrate the processing of the pin assembly structure by a Printed Circuit Board (PCB) process according to the present disclosure.

Figure 12A:
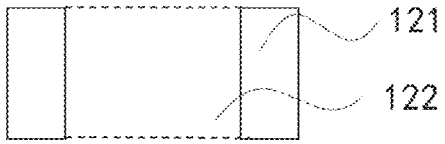
FIG. 12*a* to FIG. 12*d* schematically illustrate the processing of the pin assembly structure by a Printed Circuit Board (PCB) process according to the present disclosure.
Figure 12B:
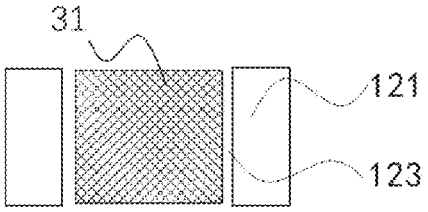
Figure 12C:
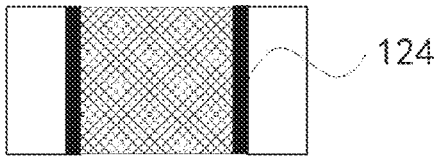
Figure 12D:
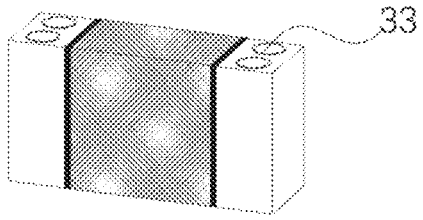

The tenth embodiment is consistent with the basic feature of the first embodiment. FIG. 12*a* to FIG. 12*d* illustrate the processing of the pin assembly structure by a PCB process. In FIG. 12*a*, a PCB core board 121 is selected, and an empty slot 122 is excavated by a cutting process. The core board 121 is a glass fiber reinforced organic insulating material including glass fiber, insulated basis material and the like. In FIG. 12*b*, a preformed metal block 31 is sunk into the empty slot 122, and a space 123 is formed between the metal block 31 and the core board 121 at this time. In FIG. 12*c*, a layer of half cured sheet 124 is pressurized, the space 123 between the metal block and the core board is filled. In FIG. 12*d*, a hole is drilled (mechanical drilling, or laser drilling), and a signal pin 33 is formed on the surface of a through hole of the plastic member 121 by electroplating or electroless plating process. The advantage of the embodiment is that the PCB process is a commonly used process in the industry, and the manufacturing process thereof and the supply chain thereof are relatively mature. It shall be noted that when using the PCB process for manufacturing, the pin assembly structure is generally made in a contiguous panel form, and then being divided into a plurality of connection terminals, so as to improve the production efficiency.

Moreover, although the steps of the method of the present disclosure are described in a particular sequence in the drawings, this does not require or imply that these steps must be performed in the particular sequence or that all of the illustrated steps have to be performed in order to achieve the expected results. Additionally or alternatively, certain steps may be omitted, multiple steps may be combined into one step to execute, and/or one step may be broken down into multiple steps to execute, etc.

It should be noted that while a plurality of modules or units of the device for action execution have been mentioned in the detailed description above, this division is not mandatory. In fact, according to the embodiments of the present disclosure, the features and functions of the two or more modules or units described above may be embodied in one module or unit. On the contrary, the features and functions of one module or unit described above can be further divided to be embodied by multiple modules or units.

Other embodiments of the invention will be apparent to those skilled in the art from consideration of the specification and practice of the present disclosure disclosed here. This application is intended to cover any variations, uses, or adaptations of the invention following the general principles thereof and including such departures from the invention as coming within known or customary practice in the art. The description and embodiments are to be regarded as illustrative only, and the real scope and spirit of the invention are pointed out in the appended claims.

It should be appreciated that the present disclosure is not limited to the exact construction that has been described above and illustrated in the accompanying drawings, and that various modifications and changes can be made without departing from the scope thereof. The scope of the present disclosure is limited by the appended claims only.

What is claimed is:

1. A connector, comprising:

at least one power pin, comprising a preformed metal block, the metal block comprising a plurality of side surfaces in a first direction and a first bottom surface and a second bottom surface in a second direction perpendicular to the first direction;

at least one plastic member, the at least one plastic member being connected to at least one side surface of the metal block in the first direction, and the at least one plastic member comprising a first bottom surface and a second bottom surface in the second direction; and at least one signal pin, the at least one signal pin being attached to at least one of the at least one plastic member in the first direction, extending to the first bottom surface and the second bottom surface of the at least one plastic member, and respectively forming contact surfaces with predetermined areas on the first bottom surface and the second bottom surface of the at least one plastic member;

wherein, the first bottom surface of each metal block is flush with each contact surface formed by the at least one signal pin on the first bottom surface of the at least one plastic member in the second direction, and the second bottom surface of each metal block is flush with each contact surface formed by the at least one signal pin on the second bottom surface of the at least one plastic member in the second direction;

wherein the at least one plastic member comprises at least one through hole in the first direction, at least one of the at least one signal pin is attached to a sidewall of the at least one through hole in the first direction, extends to the first bottom surface and the second bottom surface of the at least one plastic member, and forms contact surfaces with predetermined areas on the first bottom surface and the second bottom surface of the plastic member.

2. A signal pin assembly, comprising:

a plastic member, comprising a plurality of outer side surfaces in a first direction, and a first bottom surface and a second bottom surface in a second direction perpendicular to the first direction; and at least one signal pin, the at least one signal pin being attached to the plastic member in the first direction, extending to the first bottom surface and the second bottom surface of the plastic member, and respectively forming contact surfaces with predetermined areas on the first bottom surface and the second bottom surface, wherein at least one of the at least one signal pin is attached to the outer side surface of the plastic member.

3. The signal pin assembly according to claim 2, wherein a shape of a radial cross section of at least one of the at least one signal pin is a trilateral shape, a quadrilateral shape, or a circular shape.

4. The signal pin assembly according to claim 2, wherein the plastic member comprises at least one through hole in the first direction, at least one of the at least one signal pin is attached to a sidewall of the at least one through hole of the plastic member in the first direction, extends to the first bottom surface and the second bottom surface of the plastic member, and respectively forms contact surfaces with predetermined areas on the first bottom surface and the second bottom surface of the plastic member.

5. The signal pin assembly according to claim 2, wherein at least one of the at least one signal pin has a minimum dimension in the second direction greater than or equal to 50 um.

6. The signal pin assembly according to claim 2, wherein at least one of the at least one signal pin is formed by a metallization process.

* * * * *